US008621719B2

(12) United States Patent
Nakashima et al.

(10) Patent No.: US 8,621,719 B2
(45) Date of Patent: Jan. 7, 2014

(54) AUXILIARY HANDLE

(75) Inventors: Keiji Nakashima, Anjo (JP); Takuo Arakawa, Anjo (JP); Shinya Bito, Anjo (JP)

(73) Assignee: Makita Corporation, Anjo-Shi (JP)

( * ) Notice: Subject to any disclaimer, the term of this patent is extended or adjusted under 35 U.S.C. 154(b) by 384 days.

(21) Appl. No.: 12/457,489

(22) Filed: Jun. 12, 2009

(65) Prior Publication Data

US 2009/0307875 A1 Dec. 17, 2009

(30) Foreign Application Priority Data

Jun. 17, 2008 (JP) ..... 2008-158515

(51) Int. Cl.
*B25F 5/02* (2006.01)
*B25G 1/00* (2006.01)

(52) U.S. Cl.
USPC ..... 16/426; 16/422

(58) Field of Classification Search
USPC ..... 16/422, 426, 440, 446, 406, 436
See application file for complete search history.

(56) References Cited

U.S. PATENT DOCUMENTS 1,534,075 A * 4/1925 Parrish ..... 16/426
4,276,675 A * 7/1981 Pioch ..... 16/426
4,794,667 A * 1/1989 Nelson et al. ..... 16/426
4,819,742 A 4/1989 Driggers
5,025,870 A 6/1991 Gantner
5,049,012 A * 9/1991 Cavedo ..... 408/241 R
5,133,582 A * 7/1992 Rocha ..... 294/58

(Continued)

FOREIGN PATENT DOCUMENTS

DE 103 30 180 A1 1/2005
EP 1 400 317 A1 3/2004

(Continued)

OTHER PUBLICATIONS

Oct. 12, 2012 Office Action issued in Japanese Patent Application No. 2008-158515 (with translation).

*Primary Examiner* — Emily Morgan
(74) *Attorney, Agent, or Firm* — Oliff & Berridge, PLC

(57) ABSTRACT

It is an object of the invention to provide a technique for a reduction of vibration of an auxiliary handle for a hand-held power tool. The object can be achieved by a representative auxiliary handle. The auxiliary handle includes a ring-like mounting part, a pair of bases, a rod-like grip, one or arms and an elastic region. The bases are formed on a free end of the mounting part. The bases of the mounting part and extending end portions of the arms are arranged parallel to the longitudinal direction of the grip. The bases of the mounting part and the extending end portions of the arms are clamped by a bolt and a nut such that the mounting part holds the power tool body. The elastic region is provided in at least one of the mounting part, the bases and the extending end portions of the arms.

1 Claim, 14 Drawing Sheets

(56) References Cited

U.S. PATENT DOCUMENTS

| | | | | |
|---|---|---|---|---|
| 5,242,362 | A * | 9/1993 | Talamantez | 492/13 |
| 6,360,402 | B1 * | 3/2002 | Crabtree | 16/430 |
| 6,814,156 | B2 * | 11/2004 | Dieterle et al. | 173/170 |
| 7,137,542 | B2 | 11/2006 | Oki et al. | |
| 7,191,494 | B2 * | 3/2007 | Badiali | 16/426 |
| 7,823,256 | B2 * | 11/2010 | Engelfried et al. | 16/426 |
| 8,032,990 | B2 * | 10/2011 | Shinma et al. | 16/426 |
| 2002/0157214 | A1 * | 10/2002 | Hadley | 16/430 |
| 2004/0078936 | A1 * | 4/2004 | Walker et al. | 16/430 |
| 2005/0034276 | A1 * | 2/2005 | Badiali | 16/426 |
| 2005/0155186 | A1 * | 7/2005 | McGuyer et al. | 16/430 |
| 2009/0188083 | A1 * | 7/2009 | Hahn et al. | 16/426 |
| 2010/0064480 | A1 * | 3/2010 | Martin | 16/426 |
| 2010/0064482 | A1 * | 3/2010 | Martin | 16/426 |

FOREIGN PATENT DOCUMENTS

| | | | | |
|---|---|---|---|---|
| JP | A-63-312083 | | 12/1988 | |
| JP | A-02-185378 | | 7/1990 | |
| JP | U-05-086482 | | 11/1993 | |
| JP | U-07-020275 | | 4/1995 | |
| JP | 09174463 | A * | 7/1997 | B25F 5/02 |
| JP | 09225862 | A * | 9/1997 | B25F 5/02 |
| JP | 2000176864 | A * | 6/2000 | B25F 5/02 |
| JP | A 2000-176864 | | 6/2000 | |
| JP | A-2005-081517 | | 3/2005 | |

* cited by examiner

AUXILIARY HANDLE

BACKGROUND OF THE INVENTION

1. Field of the Invention

The present invention relates to a vibration reducing technique of a detachable auxiliary handle for a hand-held power tool such as a hammer and a hammer drill.

2. Description of the Related Art

In a hand-held power tool such as a hammer, it is known to provide a fixed main handle and a detachable auxiliary handle such that the user can hold the main handle with one hand and the auxiliary handle with the other hand when operating the hammer. A hammer of this type having a main handle and an auxiliary handle is disclosed, for example, in Japanese non-examined laid-open Patent Publication No. 2000-176864.

The auxiliary handle for the above-mentioned known electric hammer is D-shaped when viewed from the axial direction of the hammer bit (the longitudinal direction of the tool body). The auxiliary handle includes a rod-like grip to be held by a user, arms extending transversely from longitudinal ends of the grip, and a ring-like mounting part which holds the barrel from outside, and the extending end portions of the arms and bases of the mounting part are clamped by a bolt and a nut, so that the auxiliary handle is D-shaped.

Generally, vibration is caused in the power tool body during operation. The vibration is transmitted from the power tool body to a grip of an auxiliary handle held by a user and causes user discomfort. Thus, the known D-shaped auxiliary handle is not vibration-proof and in this point, further improvement is required.

SUMMARY OF THE INVENTION

It is, accordingly, an object of the invention to provide a technique for a reduction of vibration of an auxiliary handle for a hand-held power tool.

The above-described object can be achieved by a claimed invention. The representative auxiliary handle according to the invention includes a ring-like mounting part which is capable of holding a power tool body of a hand-held power tool from outside, a pair of bases formed on a free end of the mounting part, and a rod-like grip to be held by a user. The grip has one or more arms extending in a direction transverse to a longitudinal direction of the grip. The bases of the mounting part and extending end portions of the arms are arranged parallel to the longitudinal direction of the grip, and the bases of the mounting part and the extending end portions of the arms are clamped by a bolt and a nut such that the mounting part holds the power tool body.

The "hand-held power tool" may represent an impact tool, including a hammer which performs a hammering operation on a workpiece by striking movement of a tool bit in its axial direction, and a hammer drill which performs a hammer drill operation on a workpiece by striking movement and rotation of a tool bit. In addition to the impact tool, however, it also widely includes a cutting power tool, such as a reciprocating saw and a jig saw, which performs a cutting operation on a workpiece by reciprocating movement of a blade.

According to a preferred embodiment of the auxiliary handle in this invention, an elastic region for vibration reduction is provided in at least one of the mounting part, the bases and the extending end portions of the arms. The manner in which "an elastic region is provided" suitably includes the manner in which an elastic element, typically in the form of rubber, is disposed between two adjacent members and also the manner in which one member is divided into two segments and the segments are joined together into one piece via an elastic element such as rubber. According to this invention, by provision of the elastic region for vibration reduction, vibration which may be transmitted from the power tool body to the grip of the auxiliary handle can be reduced by the elastic region, so that load on the user can be alleviated.

According to a further embodiment of the auxiliary handle in this invention, the elastic region is provided on a holding face of the mounting part which holds the power tool body. The manner in which the elastic region is provided on a holding face of the mounting part suitably includes the manner in which a sheet- or plate-type elastic rubber is arranged to cover all over the holding face and the manner in which elastic rubber is scattered on the holding face.

According to this invention, by provision of the elastic region on the holding face of the mounting part, transmission of vibration from the power tool body to the mounting part can be reduced, and thus vibration of the grip can be reduced. Further, if the elastic region comprises an elastic rubber, the elastic rubber serves as a slip stopper and can prevent the auxiliary handle from being displaced with respect to the power tool body.

According to a further embodiment of the auxiliary handle in this invention, a ring component and the associated base of the mounting part are joined together into one piece via the elastic region. The manner in which the ring component and the base are "joined together via the elastic region" represents the manner in which an elastic material such as rubber is integrally formed with the ring component and the base which are separately formed.

According to this invention, transmission of vibration from the mounting part to the grip can be reduced. Further, due to the configuration of the mounting part itself having the elastic region and formed in one piece, the number of parts can be reduced and ease of assembly can be enhanced.

According to a further embodiment of the auxiliary handle in this invention, a surrounding member is further provided which surrounds the base of the mounting part and is prevented from moving in a circumferential direction with respect to the extending end portion of the arm. Further, the elastic region is provided between an inner circumferential surface of the surrounding member and an outer circumferential surface of the base. With this construction, transmission of vibration from the base of the mounting part to the surrounding member can be reduced, and thus vibration of the grip can be reduced.

According to a further embodiment of the auxiliary handle in this invention, the base and the surrounding member have respective flat surfaces which are opposed to each other in a direction of tightening by the bolt and the nut, and a washer is disposed between the opposed flat surfaces. In a construction in which an elastic region is disposed between the base and the surrounding member, the base and the surrounding member have respective sliding areas therebetween which move in contact with respect to each other in a direction of tightening by the bolt and the nut when the elastic region elastically deforms. In this invention, the sliding areas which slide with respect to each other are flat surfaces and the washer is disposed therebetween. With this construction, slip and thus wear resistance of the sliding areas can be improved.

According to a further embodiment of the auxiliary handle in this invention, an intermediate member is disposed between the base of the mounting part and the extending end portion of the arm and prevented from moving in a circumferential direction with respect to the base of the mounting part. One of the extending end portion and the intermediate member has a projection extending in an axial direction of the bolt, while the other of the extending end portion and the intermediate member has a recess which is fitted on the projection in such a manner as to be movable with respect to the projection. Further, the elastic region is provided between an outer circumferential surface of the projection and an inner circumferential surface of the recess. With this construction, transmission of vibration from the intermediate member to the extending end portion of the arm can be reduced by the elastic region, and thus vibration of the grip can be reduced.

According to a further embodiment of the auxiliary handle in this invention, a washer is disposed between an end surface of the projection in the longitudinal direction and a bottom of the recess which are opposed to each other in a direction of tightening by the bolt and the nut. In a construction in which an elastic region is disposed between the outer circumferential surface of the projection and the inner circumferential surface of the recess, the outer circumferential surface of the projection and the inner circumferential surface of the recess have respective sliding areas therebetween which move in contact with respect to each other in a direction of tightening by the bolt and the nut when the elastic region elastically deforms. In this invention, the washer is disposed between the sliding areas which slide with respect to each other. With this construction, slip and thus wear resistance of the sliding areas can be improved.

According to a further embodiment of the auxiliary handle in this invention, in a construction in which the elastic region is disposed between the outer circumferential surface of the projection and the inner circumferential surface of the recess, the elastic region comprises a spherical or pin-like rubber and is supported by the recess and the projection such that deformation of the spherical or pin-like rubber comprises shear deformation at least in the direction of a z-axis where the direction of the z-axis defined by a longitudinal axis of the power tool body and directions of a y-axis and an x-axis which intersect with the z-axis are concerned. The deformation may suitably include deformation comprising shear deformation exclusively, and deformation comprising shear deformation accompanied by compressive deformation. Further, the manner in which the elastic region is "supported" in this invention suitably embraces the manner in which the recess and the projection are joined to the spherical or pin-like rubber, for example, by adhesives, and the manner in which the recess and the projection support the spherical or pin-like rubber by frictional force caused in the contact surfaces therebetween, and the manner in which the spherical or pin-like rubber is engaged in engagement recesses formed in the outer circumferential surface of the projection and the inner circumferential surface of the recess.

The spherical or pin-like rubber has a property that its shear rigidity is lower than its compressive rigidity, or specifically, the effect of vibration reduction by shear deformation is higher than the effect of vibration reduction by compressive deformation. In this invention, by utilizing this property, or by a vibration damping action which is caused by shear deformation of the spherical or pin-like rubber at least in the z-axis direction, transmission of vibration from the power tool body to the grip can be reduced. Thus, the effect of reducing vibration of the grip can be enhanced.

According to a further embodiment of the auxiliary handle in this invention, the grip has two arms extending from longitudinal ends of the grip in a direction transverse to the longitudinal direction, and the extending end portions of the arms are connected together by a transverse part which extends transversely to the arms, so that the grip is configured as a closed-loop frame structure. By provision of such a closed-loop frame structure, the rigidity of the grip can be increased and the durability can be enhanced.

According to a further embodiment of the auxiliary handle in this invention, the grip has two arms extending from longitudinal ends of the grip in a direction transverse to the longitudinal direction, and the extending end portion of one of the arms is fixed to the base of the mounting part by the bolt and the nut, while the extending end portion of the other arm has a free end. With such a construction, the other arm of which extending end portion has a free end can be used as a hook, so that the convenience in storing the auxiliary handle is enhanced.

According to a further embodiment of the auxiliary handle in this invention, the grip has three arms which extend from the both longitudinal ends of the grip and from a midpoint therebetween respectively in a direction transverse to the longitudinal direction of the grip, and the extending end portion of the middle one of the three arms is fixed to the base of the mounting part by the bolt and the nut, while each of the extending end portions of the other two arms has a free end. According to this invention, the auxiliary handle is generally T-shaped in appearance and each of the other two arms of which extending end portion has a free end can be used as a hook, so that convenience in storing the auxiliary handle is enhanced.

According to a further embodiment of the auxiliary handle in this invention, a dynamic vibration reducer is installed in the grip and has a different elastic element from the elastic region and a weight which moves with respect to the grip via the elastic element. With this construction, vibration which is transmitted to the grip without being completely reduced by the elastic region can be further reduced, so that the effect of reducing vibration of the grip can be further enhanced.

According to a further embodiment of the auxiliary handle in this invention, the grip is hollow, and the weight is disposed in a hollow portion of the grip and has a columnar shape extending in the longitudinal direction of the grip. Further, the elastic element is spherical and disposed between a recess formed in an end of the weight in an extending direction of the weight and a recess opposed to the recess of the weight and formed in an inner wall surface of the hollow portion of the grip. According to this invention, the elastic element supports each of the longitudinal ends of the weight disposed in the hollow portion of the grip, so that it can elastically support the weight in a rational manner without need of changing the diameter of the grip and can perform a vibration reducing function. Further, in addition to the support of the weight at the both ends by the elastic element, the elastic element is supported by a spherical surface, so that the vibration reducing effect can be obtained in each of the direction of the z-axis defined by the longitudinal axis of the power tool body and the directions of a y-axis and an x-axis which intersect with the z-axis.

According to a further embodiment of the auxiliary handle in this invention, a hand-held power tool is provided which has the auxiliary handle as defined in any claims. With this construction, a hand-held power tool can be provided which has the auxiliary handle having a higher effect of reducing vibration of the grip. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved auxiliary handles and method for using such auxiliary handles and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment of the Invention

Figure 1:
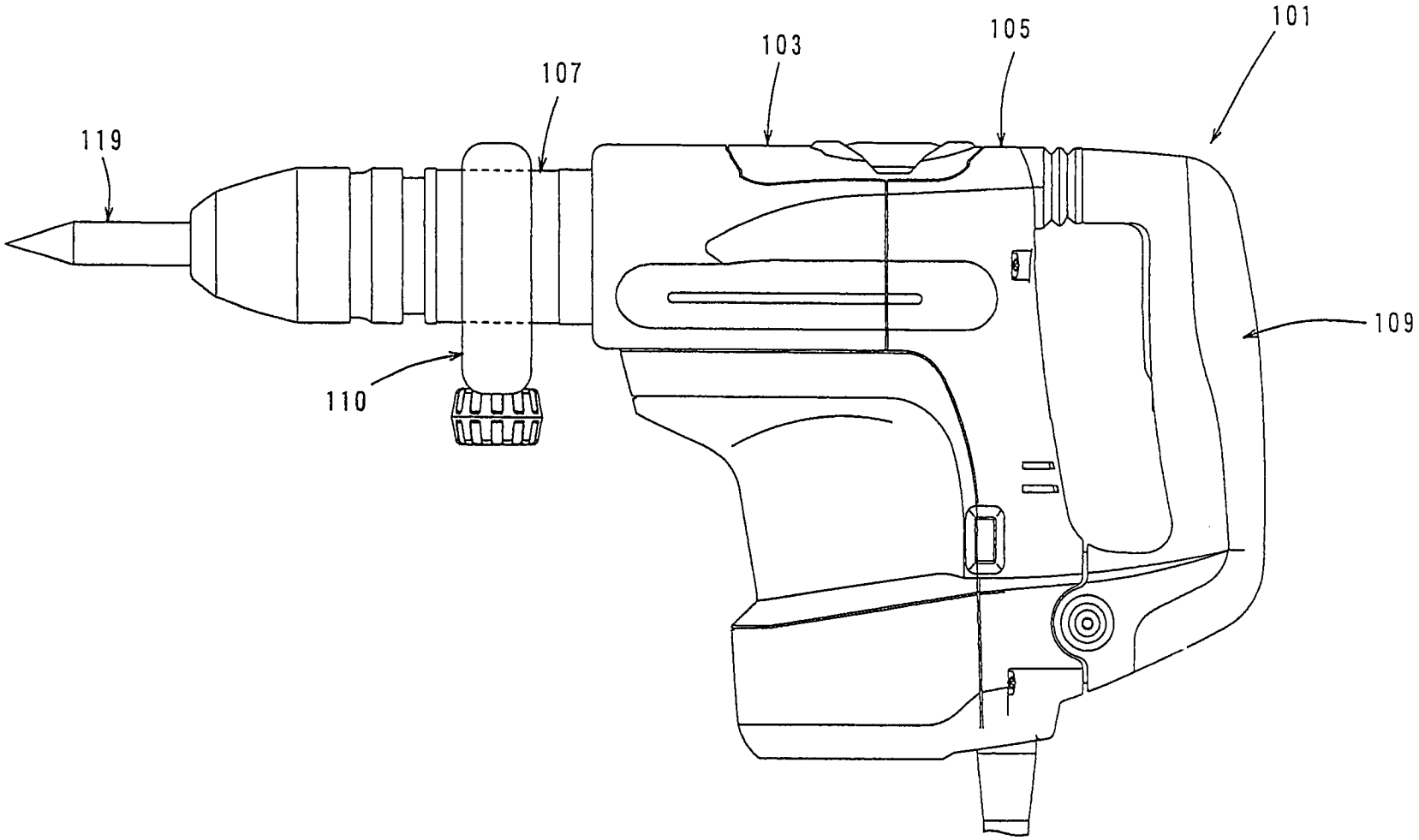
FIG. 1 is an external view showing an electric hammer drill with an auxiliary handle in the form of a side handle according to a first embodiment of the present invention.
Figure 2:
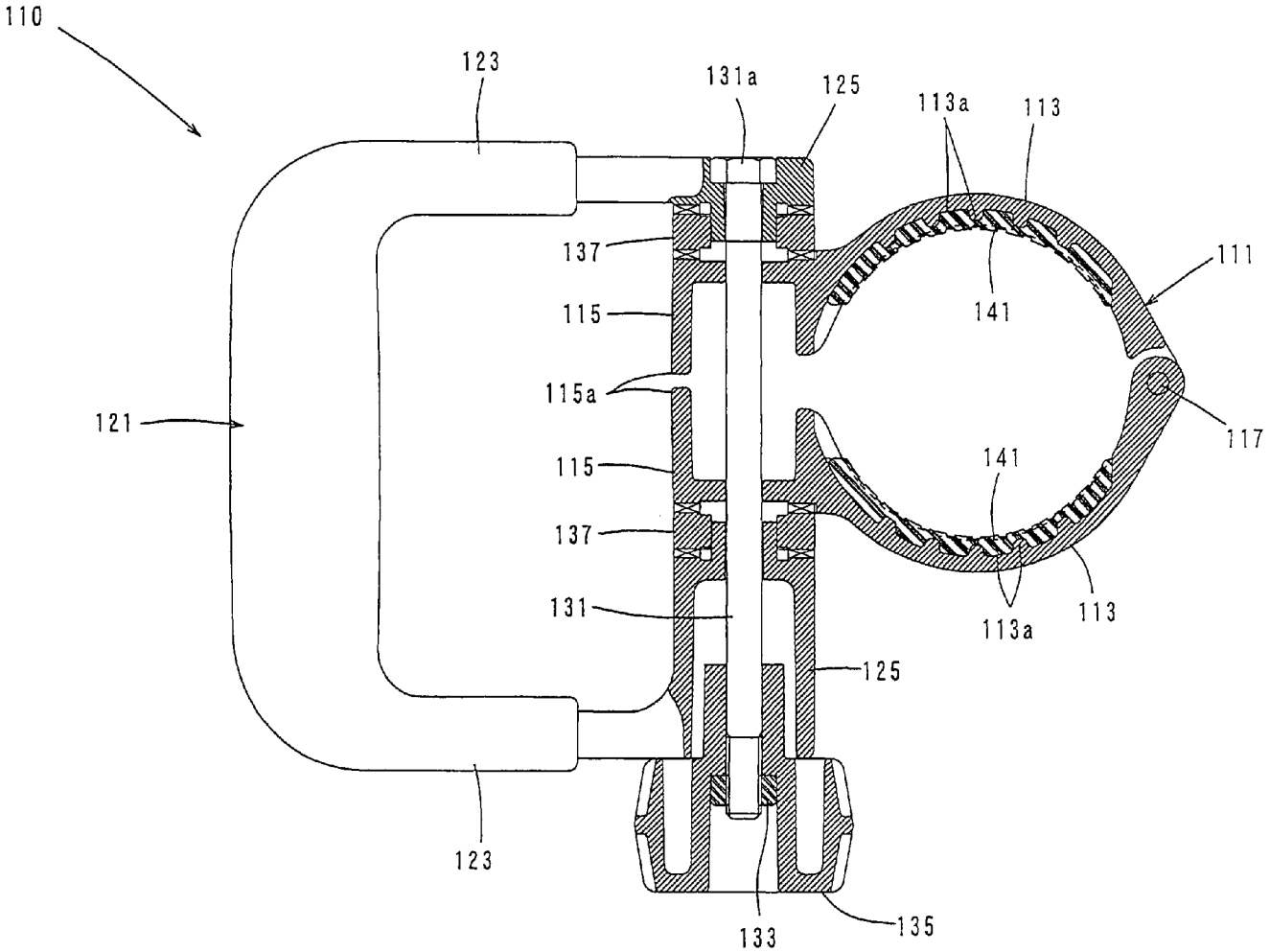
FIG. 2 is a partially sectional view showing the construction of the side handle.

An auxiliary handle according to a first embodiment of the present invention is now described with reference to FIGS. 1 and 2. This embodiment is explained as being applied to an electric hammer drill as a representative example of a hand-held power tool. FIG. 1 is an external view showing an electric hammer drill 101 with an auxiliary handle in the form of a side handle. The construction of the hammer drill 101 is now briefly explained with reference to FIG. 1. The hammer drill 101 mainly includes a body 103 that forms an outer shell of the hammer drill 101, a hammer bit 119 detachably coupled to the tip end region (on the left side as viewed in FIG. 1) of the body 103 via a tool holder (not shown), and a main handle 109 connected to the body 103 on the side opposite to the hammer bit 119 and designed to be held by a user. The body 103 is a feature that corresponds to the "power tool body" according to the present invention. The hammer bit 119 is held by the tool holder such that it is allowed to reciprocate with respect to the tool holder in its axial direction and prevented from rotating with respect to the tool holder in its circumferential direction. In the present embodiment, for the sake of convenience of explanation, the side of the hammer bit 119 is taken as the front side and the side of the main handle 109 as the rear side.

The body 103 mainly includes a housing 105 and a barrel 107 connected to the front end of the housing 105. The body 103 houses a driving motor, a motion converting mechanism in the form of a crank mechanism which converts rotation of the driving motor into linear motion, a striking mechanism having a striker (striking element) that strikes the hammer bit 119 in the axial direction and an impact bolt (intermediate element) that transmits the striking movement of the striker to the hammer bit 119, and a power transmitting mechanism that reduces the speed of rotation of the driving motor and transmits the rotation to the hammer bit 119.

In the hammer drill 101 thus constructed, when the driving motor is driven, a striking force is applied to the hammer bit 119 in the axial direction from the crank mechanism via the striking mechanism, and at the same time, a rotating force is also applied to the hammer bit 119 in the circumferential direction via the power transmitting mechanism. Thus, the hammer bit 119 performs a drilling operation on a workpiece (concrete) by a hammering movement in the axial direction and a drilling movement in the circumferential direction. The hammer drill 101 can be appropriately switched between a hammering operation mode in which only a striking force in the axial direction is applied to the hammer bit 119, and a hammer drill operation mode in which a striking force in the axial direction and a rotating force in the circumferential direction are applied to the hammer bit 119.

The auxiliary handle in the form of a side handle 110 according to this embodiment is detachably mounted onto a barrel 107 of the hammer drill 101. In FIG. 1, the side handle 110 is shown mounted on the left side of the hammer drill so as to be held by the user's left hand. The construction of the side handle 110 is now described with reference to FIG. 2, which shows the side handle 110 partially in section. The side handle 110 mainly includes a mounting ring 111 which is detachably mounted onto the generally cylindrical barrel 107 by holding the outer circumferential surface of the barrel 107 from the outside, a grip 121 connected to the mounting ring 111, and a fixing (clamping) means which includes a through bolt 131 and a clamping knob 135 with a nut 133 and serves to clamp and loosen the mounting ring 111. The mounting ring 111 and the grip 121 are features that correspond to the "mounting part" and the "grip", respectively, according to this invention. Further, the through bolt 131 and the clamping knob 135 with the nut 133 are features that correspond to the "bolt" and the "nut", respectively, according to this invention.

The mounting ring 111 includes a pair of upper and lower generally semi-circular arc ring components 113. The mounting ring 111 is formed by connecting one end of each of the ring components 113 to one end of the other so as to be rotatable with respect to each other via a shaft 117 which extends parallel to the longitudinal direction of the barrel 107. A base 115 extends outward from the other free end of each of the ring components 113. The ring component 113 and the base 115 are features that correspond to the "ring component" and the "base", respectively, according to this invention.

The grip 121 has a rod-like shape having a generally circular section and has upper and lower arms 123 which extend parallel to each other from the both longitudinal (vertical) ends of the grip 121 toward the mounting ring 111 in a direction transverse to the longitudinal direction of the grip 121. The bases 115 of the mounting ring 111 are disposed between extending end portions 125 of the upper and lower arms 123 via upper and lower ring-like cams 137. Specifically, the bases 115 of the mounting ring 111 and the extending end portions 125 of the upper and lower arms 123 are aligned in a direction transverse to the longitudinal direction of the barrel 107 (in a vertical direction) via the upper and lower cams 137. The extending end portions 125 are features that correspond to the "extending end portions" according to this invention.

The extending end portions 125 of the arms 123, the cams 137 and the bases 115 of the mounting ring 111 which are arranged and aligned as described above have respective holes aligned in the vertical direction, and the through bolt 131 is loosely inserted through these holes in the vertical direction. The through bolt 131 has a head 131*a* on one end, and the head 131*a* engages with a side (bottom of a counterbore) of the extending end portion 125 of the one (upper) arm 123 so that the maximum insert position is defined. The other end of the through bolt 131 protrudes through the extending end portion 125 of the other (lower) arm 123, and the nut 133 of the clamping knob 135 is threadably mounted on a thread of the through bolt 131. The end surface of the clamping knob 135 faces the outer surface of the extending end portion 125 of the arm 123 such that it can contact the outer surface. Further, the nut 133 is fixedly disposed inside the clamping knob 135.

A cam face having generally V-shaped indentations is formed in the both sides (both end surfaces in the axial direction) of each of the upper and lower cams 137 in the circumferential direction. The upper and lower extending end portions 125 and the upper and lower bases 115 also have respective cam faces having generally V-shaped indentations, corresponding to the cam faces of the cams 137, on their respective sides which face the cam faces of the cams 137.

When the clamping knob 135 is turned in one direction (tightening direction), the through bolt 131 and the clamping knob 135 cooperate to clamp the extending end portions 125 of the upper and lower arms 123 and move them (by elastic deformation of the arms 123) in a direction that lessens a space therebetween (toward each other). As a result, the bases 115 of the mounting ring 111 are also moved via the upper and lower cams 137 toward each other in a direction that lessens the diameter of the ring components 113. Thus, the mounting ring 111 is clamped onto the barrel 107. Further, a stopper 115*a* is formed on each of the sides of the bases 115 of the ring components 113 which face the other. The stoppers 115*a* come into contact with each other during clamping operation and thereby prevent the mounting ring 111 from being excessively clamped.

When the clamping knob 135 is turned in the other direction (loosening direction), clamping by the through bolt 131 and the clamping knob 135 is released. Thus, the extending end portions 125 of the upper and lower arms 123 and the bases 115 of the mounting ring 111 return to their yet-to-be clamped initial position, so that the mounting ring 111 is released from the barrel 107. After release of the mounting ring 111 from the barrel 107, when the clamping knob 135 is further turned in the loosening direction, the engagement between the cam faces of the cams 137 and the cam faces of the bases 115 or the extending end portions 125 is released, so that the cam teeth are allowed to climb over each other. In this state, fore-and-aft adjustments of the grip 121 can be made in increments of the angle corresponding to the pitch of the cam teeth by turning the arms 123 on the axis of the through bolt 131.

As described above, in this embodiment, the mounting ring 111 and the grip 121 are fixed to each other by clamping the extending end portions of the ring components 113 or the bases 115 and the free ends of the arms 123 or the extending end portions 125 together via the cams 137 by means of the through bolt 131 and the clamping knob 135 with the nut. A plurality of components including the bases 115 of the ring components 113, the extending end portions 125 of the arms 123 and the cams 137 are thus assembled into a handle body.

In this embodiment, a sheet-like (or plate-like) elastic rubber 141 is placed on an inner circular arc surface of each of the ring components 113 of the mounting ring 111. The elastic rubber 141 is a feature that corresponds to the "elastic region" according to this invention. The elastic rubber 141 is joined to the inner circular arc surface of the ring component 113, for example, by molding using a mold. In this case, projections and depressions 113*a* are formed discontinuously in the circumferential direction in the inner circular arc surface of the ring component 113. Therefore, the joint area between the inner circular arc surface and the elastic rubber 141 can be increased and thus the joint strength can be increased.

When the user holds the main handle 109 and the side handle 110 of the hammer drill 101 and performs an operation, such as a hammering operation and a hammer drill operation, impulsive and cyclic vibration is caused in the body 103 of the hammer drill 101. This vibration is then transmitted from the barrel 107 to the side handle 110. In this embodiment, however, the elastic rubber 141 is provided between the barrel 107 and the mounting ring 111, so that transmission of vibration from the body 103 or the barrel 107 to the side handle 110 side can be reduced by elastic deformation of the elastic rubber 141. Further, in this embodiment, the elastic rubber 141 also serves as a slip stopper and can prevent the side handle 110 from being displaced with respect to the barrel 107.

Second Embodiment of the Invention

Figure 3:
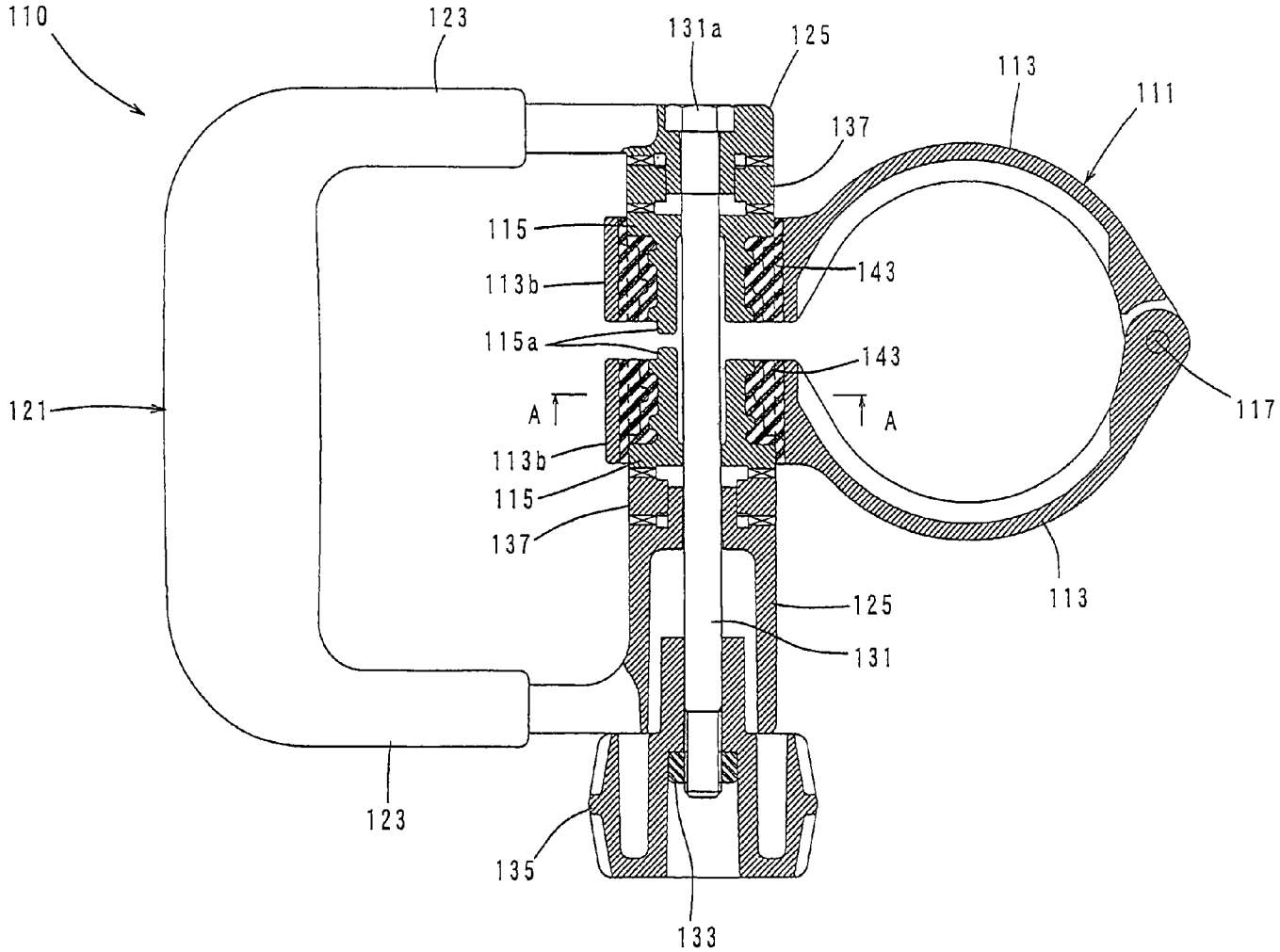
FIG. 3 is a partially sectional view showing the construction of the side handle according to a second embodiment of the invention.
Figure 4:
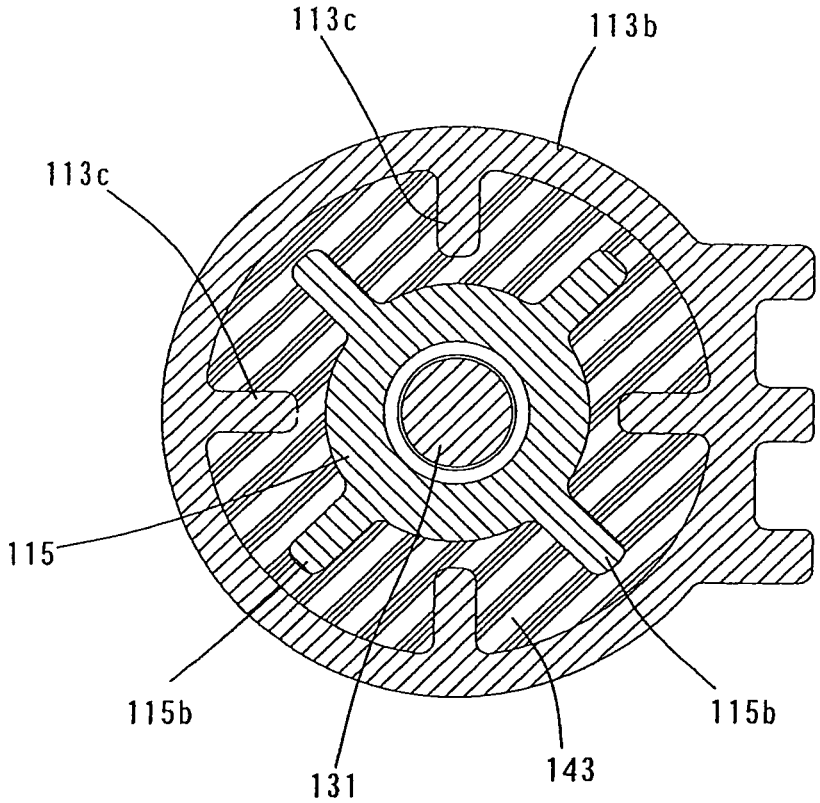
FIG. 4 is a sectional view taken along line A-A in FIG. 3.

A second embodiment of the present invention is now described with reference to FIGS. 3 and 4. FIG. 3 shows the side handle 10 partially in section, and FIG. 4 is a sectional view taken along line A-A in FIG. 3. This embodiment is a modification to the vibration reducing structure of the side handle 110, and in the other points, it has the same construction as the above-described first embodiment. Components or elements in the second embodiment which are substantially identical to those in the first embodiment are given like numerals as in the first embodiment and will not be described or will be only briefly described.

In this embodiment, the upper and lower ring components 113 of the mounting ring 111 and the bases of the ring components 113 are separately formed and joined together via an elastic rubber 143, so that transmission of vibration from the ring components 113 to the bases 115 is reduced. The elastic rubber 143 is a feature that corresponds to the "elastic region" according to this invention.

Each of the bases 115 has a tubular shape having a hole through which the through bolt 131 is loosely inserted. The base 115 has a cam face which is formed on its side facing the cam 137 and engages with the cam face of the cam 137. Further, the base 115 has a plurality of ribs 115*b* extending radially outward from its outer circumferential surface and arranged at predetermined intervals in the circumferential direction. The end of the ring component 113 is formed as a cylindrical portion 113*b* having an inside diameter large enough to receive the base 115. The cylindrical portion 113*b* has a plurality of ribs 113*c* extending radially inward from its inner circumferential surface. The base 115 is arranged substantially coaxially with the cylindrical portion 113*b* within the cylindrical portion 113*b*. In this state, the elastic rubber 143 is integrally formed in a clearance between the cylindrical portion 113*b* and the base 115, so that the cylindrical portion 113*b* and the base 115 are joined into one piece.

In the side handle 110 having the above-described construction according to this embodiment, transmission of vibration from the ring component 113 to the base 115 can be reduced by elastic deformation of the elastic rubber 143 provided between the cylindrical portion 113*b* and the base 115. Further, according to this embodiment, the mounting ring 111 itself has the elastic rubber 143 and is formed in one piece, so that the number of parts can be reduced and thus ease of assembly can be improved. Further, by providing ribs 115*b*, 113*c* on the outer circumferential surface of the base 115 and the inner circumferential surface of the cylindrical portion 113*b*, the area of contact between the base 115 and the cylindrical portion 113*b* can be increased and thus the joint strength can be increased.

Third Embodiment of the Invention

Figure 5:
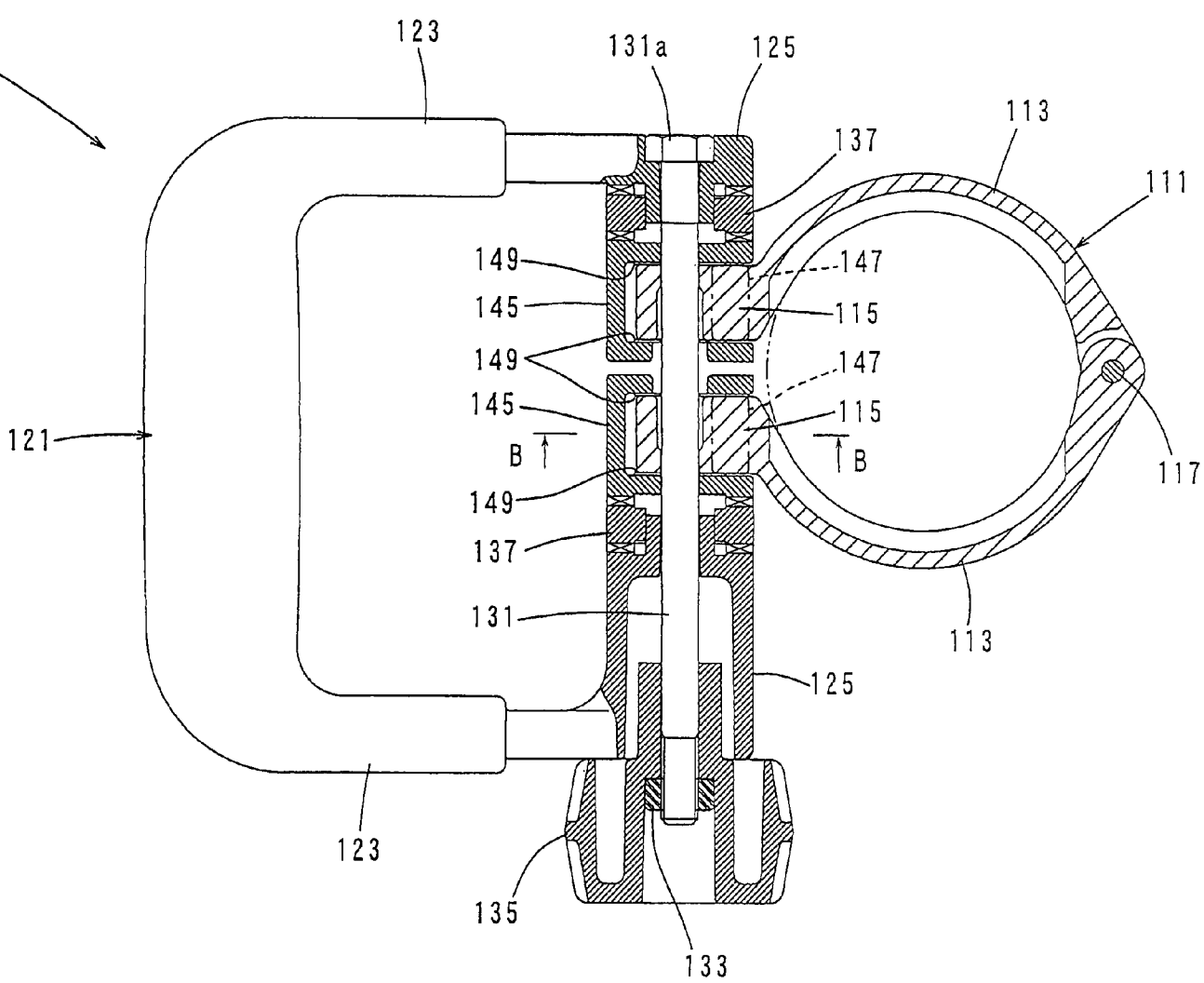
FIG. 5 is a partially sectional view showing the construction of the side handle according to a third embodiment of the invention.
Figure 6:
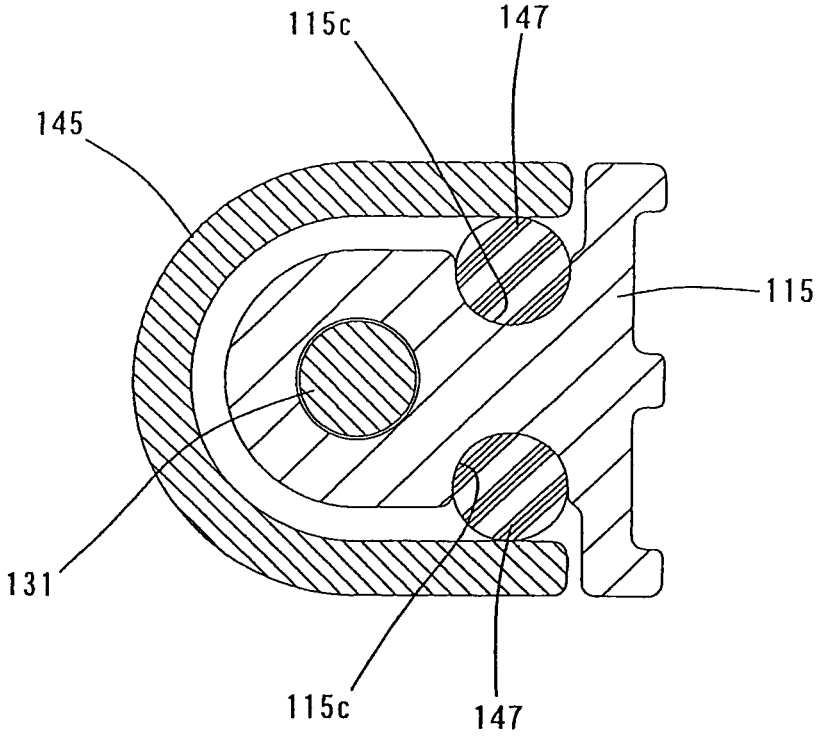
FIG. 6 is a sectional view taken along line B-B in FIG. 5.

A third embodiment of the present invention is now described with reference to FIGS. 5 and 6. FIG. 5 shows the side handle 110 partially in section, and FIG. 6 is a sectional view taken along line B-B in FIG. 5. This embodiment is a modification to the vibration reducing structure of the side handle 110, and in the other points, it has the same construction as the above-described first embodiment. Components or elements in the third embodiment which are substantially identical to those in the first embodiment are given like numerals as in the first embodiment and will not be described or will be only briefly described.

In this embodiment, upper and lower rubber receiving members 145 are each provided on the mounting ring 111 in such a manner as to individually surround the associated bases 115 of the upper and lower ring components 113. An elastic rubber 147 is disposed between the rubber receiving member 145 and the base 115. The rubber receiving member 145 and the elastic rubber 147 are features that correspond to the "surrounding member" and the "elastic region", respectively, according to this invention. The rubber receiving members 145 are disposed between the extending end portions 125 of the upper and lower arms 123 via the cams 137 and clamped by the through bolt 131 and the clamping knob 135 with the nut 133.

As shown, each of the rubber receiving members 145 has a box-like shape which surrounds or covers the base 115 substantially in its entirety, or specifically, all sides of the base 115 except its region of connection with the ring component 113. Further, the rubber receiving member 145 has a through hole through which the through bolt 131 extends, and has a cam face that engages with the cam face of the associated cam 137. Therefore, when the through bolt 131 and the clamping knob 135 with the nut 133 are tightened, the rubber receiving member 145 is connected to the associated extending end portion 125 of the arm 123 via the cam 137. Further, a predetermined clearance is provided between the inner surface of the rubber receiving member 145 and the outer surface of the base 115 so as to allow the rubber receiving member 145 and the base 115 to move with respect to each other even when the through bolt 131 and the clamping knob 135 with the nut 133 are tightened.

As shown in FIG. 6, the elastic rubber 147 is disposed on each of the front and rear sides between the inner surface of the rubber receiving member 145 and the outer surface of the base 115, or specifically, between surfaces of the both members 145, 115 which extend in a direction parallel to the tightening direction of the through bolt 131 and the nut 133. Each of the elastic rubbers 147 is columnar and arranged such that its longitudinal direction is parallel to the axial direction of the through bolt 131 (to the vertical direction). Further, the elastic rubber 147 is supported by front and rear engagement recesses 115*c* which have a semicircular section and are formed in the front and rear outer surfaces of the base 115, and held in contact with the front and rear inner surfaces of the rubber receiving member 145. Specifically, the elastic rubbers 147 are disposed between the base 115 and the rubber receiving member 145 in a manner of being pinched therebetween from the front and the rear (in the axial direction of the hammer bit 119). With this construction, the rubber receiving member 145 and the base 115 are allowed to move with respect to each other in a horizontal direction by elastic deformation of the elastic rubbers 147.

During operation of the hammer drill 101, vibration is caused in the body 103 by striking movement of the hammer bit 119, and this vibration is mainly caused in the axial direction of the hammer bit 119. In this embodiment, the elastic rubbers 147 are held by the base 115 and the rubber receiving member 145 from the front and the rear, so that the vibration caused in the axial direction of the hammer bit 119 can be efficiently reduced by elastic deformation of the elastic rubbers 147.

Further, in this embodiment, a washer 145 is disposed on each of the upper and lower sides between the inner surface of the rubber receiving member 145 and the outer surface of the base 115, or specifically, between upper and lower opposing flat surfaces of the both members 145, 115 which extend in a direction transverse to the tightening direction of the through bolt 131 and the nut 133. When the elastic rubbers 147 elastically deforms by vibration, the rubber receiving member 145 and the base 115 slide with respect to each other on their upper and lower opposing surfaces. In this embodiment, by provision of the washers 149 between these sliding surfaces which slide with respect to each other, slip and thus wear resistance of the sliding areas can be improved.

Fourth Embodiment of the Invention

Figure 7:
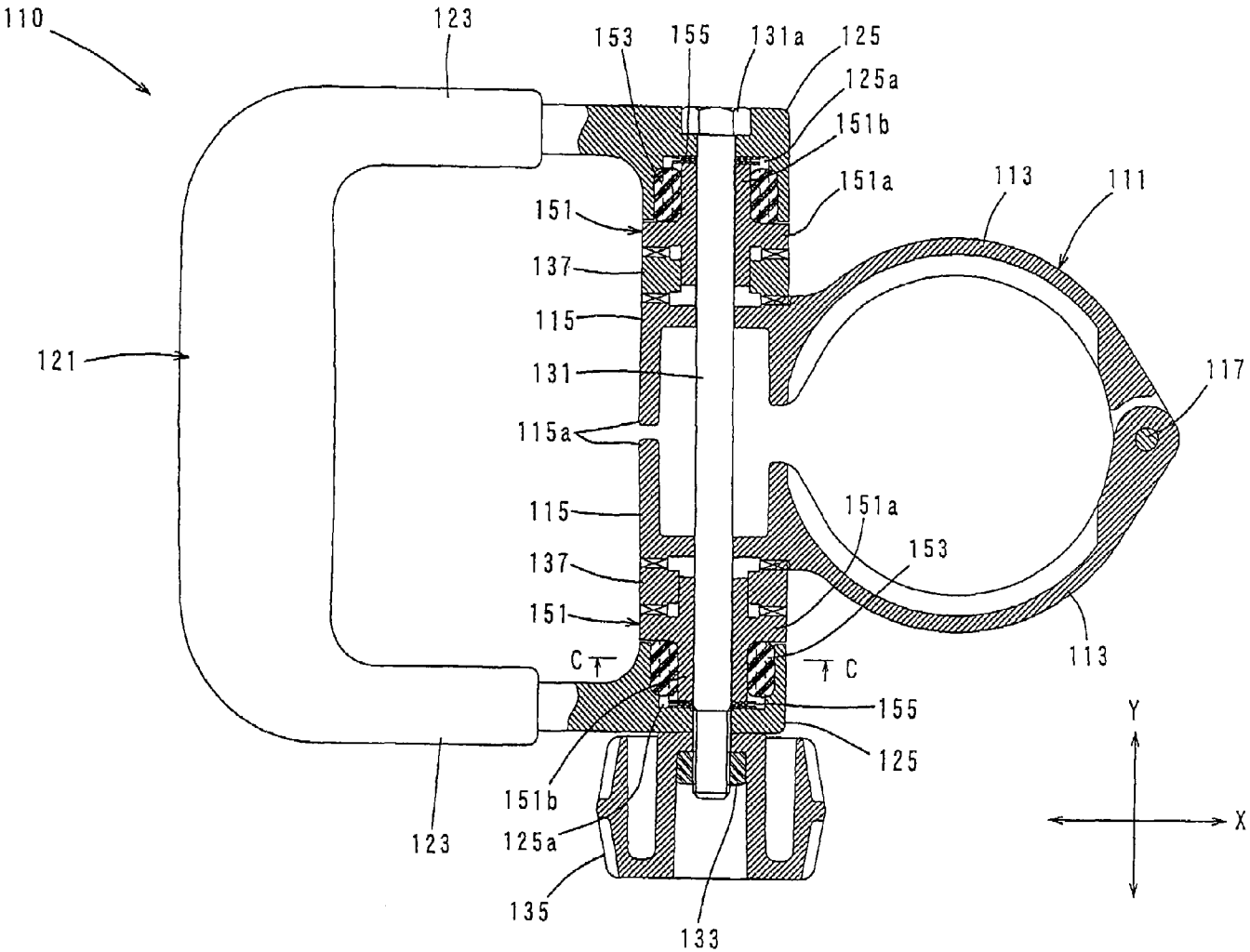
FIG. 7 is a partially sectional view showing the construction of the side handle according to a fourth embodiment of the invention.
Figure 8:
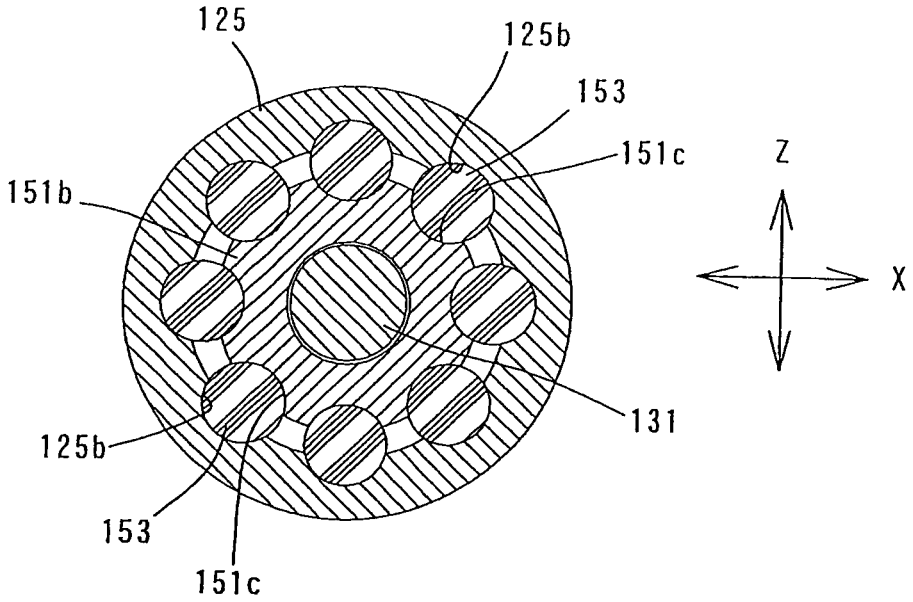
FIG. 8 is a sectional view taken along line C-C in FIG. 7.

A fourth embodiment of the present invention is now described with reference to FIGS. 7 and 8. FIG. 7 shows the side handle 110 partially in section, and FIG. 8 is a sectional view taken along line C-C in FIG. 7. This embodiment is a modification to the vibration reducing structure of the side handle 110, and in the other points, it has the same construction as the above-described first embodiment. Components or elements in the fourth embodiment which are substantially identical to those in the first embodiment are given like numerals as in the first embodiment and will not be described or will be only briefly described. In this embodiment, for the sake of convenience of explanation, the axial direction of the hammer bit 119, or the longitudinal direction of the hammer drill is taken as z-axis, the vertical direction perpendicular to the z-axis as y-axis, and the horizontal direction perpendicular to the z-axis, or the lateral direction of the hammer drill as x-axis.

In this embodiment, a rubber receiving member 151 is disposed between the extending end portion 125 of the upper arm 123 and the upper cam 137 and between the extending end portion 125 of the lower arm 123 and the lower cam 137.

Further, an elastic rubber 153 is disposed between the rubber receiving member 151 and the extending end portion 125. The rubber receiving member 151 and the elastic rubber 153 are features that correspond to the "intermediate member" and the "elastic region", respectively, according to this invention.

As shown, each of the rubber receiving members 151 has a generally cylindrical shape through which the through bolt 131 can be inserted. A flange 151*a* is formed on the outer periphery of the rubber receiving member 151 in the middle in its longitudinal direction (in the direction of the y-axis). Further, a cam face is provided on the side of the flange 151*a* which faces the cam 137 and engages with the cam face of the cam 137. Therefore, when the through bolt 131 and the clamping knob 135 with the nut 133 are tightened, the rubber receiving member 151 is connected to the base 115 of the mounting ring 111 via the cam 137.

In this embodiment, when the grip 121 of the side handle 110 is moved with respect to the mounting ring 111, elastic deformation of the elastic rubber 153 includes shear deformation in each of the directions of the z-axis and the x-axis which intersect with each other. With this construction, transmission of vibration from the body 103 side to the grip 121 can be reduced by utilizing the action of damping vibration by the shear deformation of the elastic rubber 153 in the two directions of the z-axis and the x-axis. The support structure of the elastic rubber 153 configured for this purpose is now explained.

As shown in FIG. 7, a circular recess 125*a* is formed on the side of the extending end portion 125 of the arm 123 which faces the rubber receiving member 151. An outer cylindrical portion 151*b* of the rubber receiving member 151 in the longitudinal direction is loosely fitted in the circular recess 125*a* and thus allowed to move with respect to the recess 125*a*. The circular recess 125*a* and the outer cylindrical portion 151*b* are features that correspond to the "recess" and the "projection", respectively, according to this invention. As shown in FIG. 8, a plurality of (eight in this embodiment) engagement recesses 125*b* having a semicircular section are formed in the inner circumferential surface of the circular recess 125*a* at predetermined intervals in the circumferential direction and extend in the longitudinal direction (the direction of the y-axis). Correspondingly, a plurality of engagement recesses 151*c* having a semicircular section are formed in the outer circumferential surface of the outer cylindrical portion 151*b* of the rubber receiving member 151. Columnar (pin-like) elastic rubbers 153 are held between the engagement recesses 125*b* and 151*c* which face each other. One end of each of the elastic rubbers 153 in the longitudinal direction is held in contact with an end surface of the associated engagement recess 125*b* of the circular recess 125*a*, and the other longitudinal end of the elastic rubber 153 is held in contact with an end surface of the engagement recess 151*c* of the outer cylindrical portion 151*b* (a side of the flange 151*a*).

The bottom of the circular recess 125*a* of the extending end portion 125 and the end surface of the outer cylindrical portion 151*b* of the rubber receiving member 151 are flat and a washer 155 is disposed between the flat surfaces.

In this embodiment, as described above, the elastic rubbers 153 are disposed between the inner circumferential surface of the circular recess 125*a* of the extending end portion 125 and the outer circumferential surface of the outer cylindrical portion 151*b* of the rubber receiving member 151 at predetermined intervals in the circumferential direction and supported by the engagement recesses 125*b*, 151*c*. Therefore, when vibration is inputted from the barrel 107 to the side handle 101 side in the directions of the z-axis and the x-axis, mainly a force in the shearing direction acts upon all of the elastic rubbers 153, other than those located on the z-axis and the x-axis which run through the center of the rubber receiving member 151, via its spherical contact surface in contact with the engagement recesses 125*b*, 151*c*. Specifically, the elastic deformation of the elastic rubber 153 mainly comprises shear deformation (partially accompanied by compressive deformation), and transmission of vibration from the barrel 107 (the mounting ring 111) to the grip 121 can be reduced by the vibration damping action of this shear deformation. Further, the force in the shearing direction includes a force in the direction of linearly cutting off and a force in the direction of twisting off.

Thus, according to this embodiment, by utilizing shear deformation of the elastic rubbers 153, the effect of reducing vibration of the grip 121 can be enhanced in the direction of the z-axis or the striking direction of the hammer bit 119 in which vibration reduction is particularly highly desired.

Further, in this embodiment, when the elastic rubbers 153 elastically deform by vibration, the extending end portion 125 and the rubber receiving member 151 slide with respect to each other via the washer 155. Therefore, like in the third embodiment, slip and thus wear resistance of the sliding areas can be improved.

Further, in place of the cylindrical elastic rubbers 153 in this embodiment, spherical elastic rubbers may be used. In this case, naturally, the engagement recesses 125*b*, 151*c* formed in the inner circumferential surface of the circular recess 125*a* and the outer circumferential surface of the outer cylindrical portion 151*b* are configured to have a semispherical shape. Further, a projection may be formed not on the rubber receiving member 151 side but on the extending end portion 125 side of the arm 123, while a recess may be formed not on the extending end portion 125 side but on the rubber receiving member 151.

Fifth Embodiment of the Invention

Figure 9:
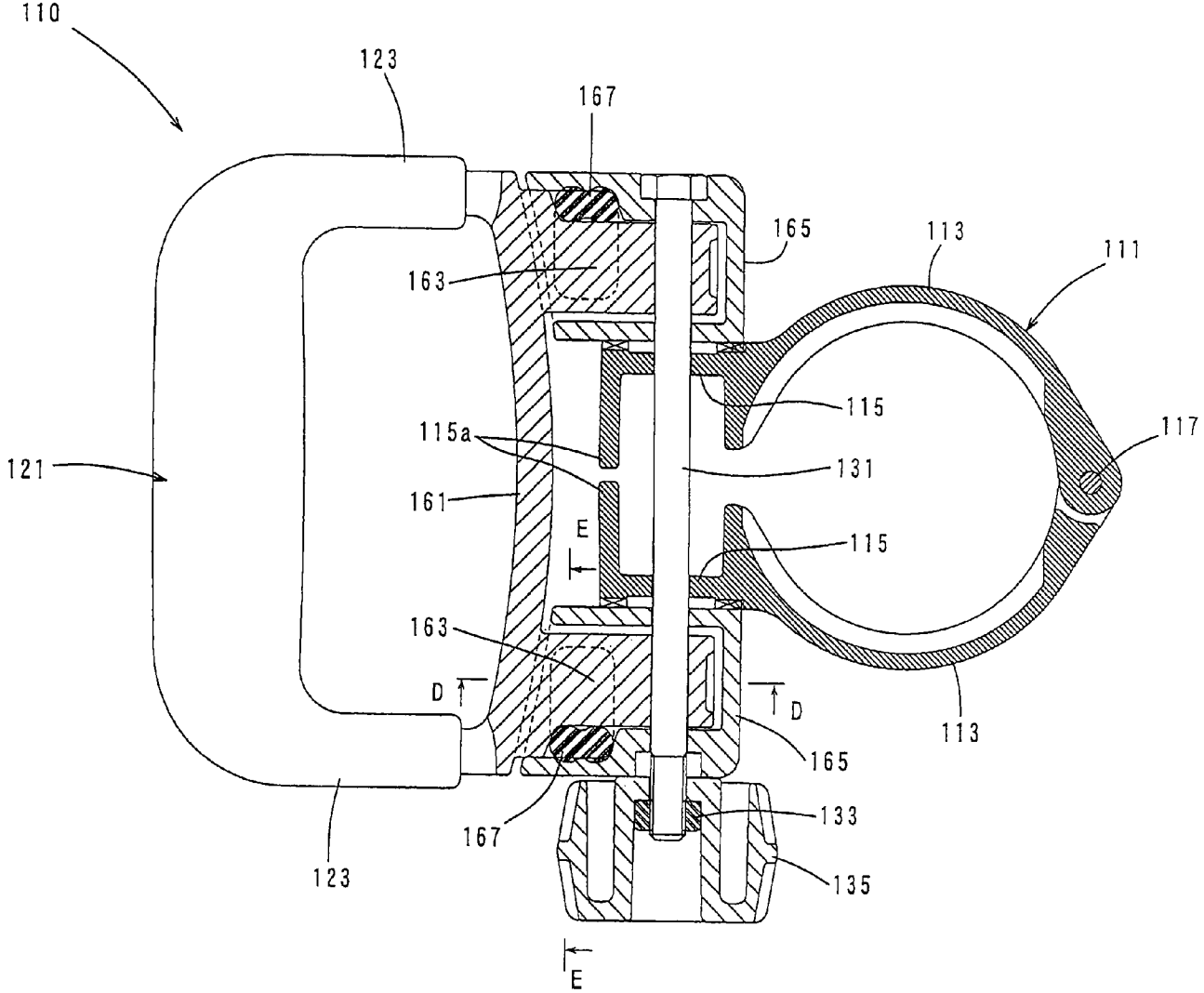
FIG. 9 is a partially sectional view showing the construction of the side handle according to a fifth embodiment of the invention.
Figure 10:
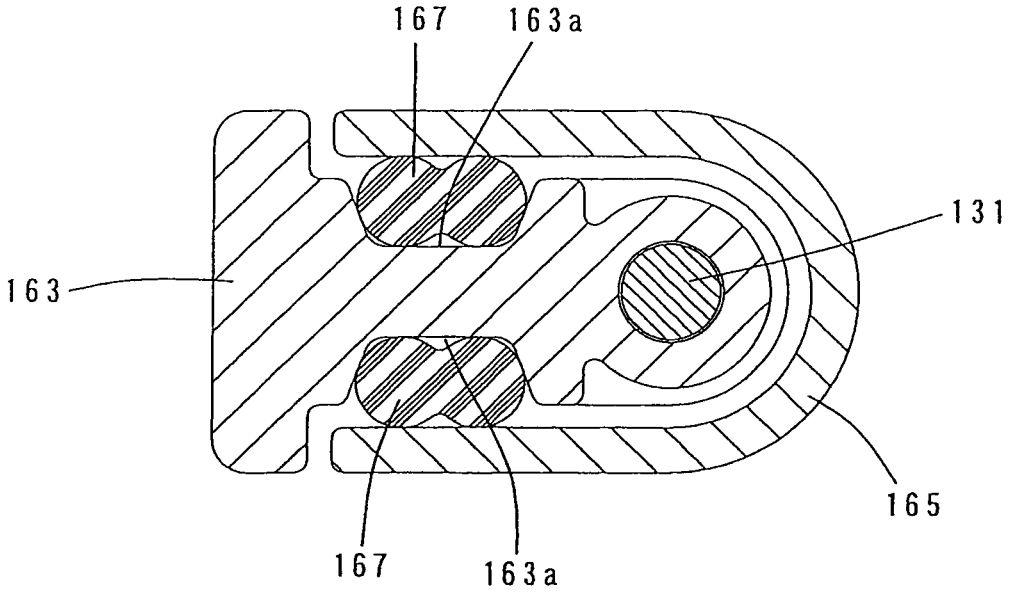
FIG. 10 is a sectional view taken along line D-D in FIG. 8.
Figure 11:
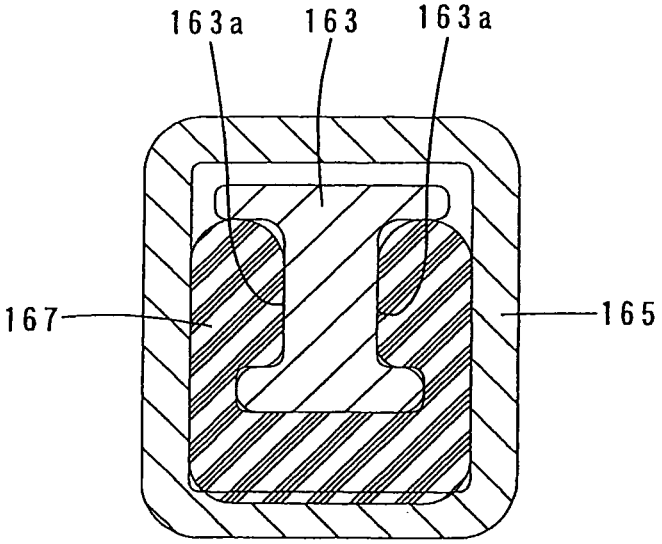
FIG. 11 is a sectional view taken along line E-E in FIG. 8.

A fifth embodiment of the present invention is now described with reference to FIGS. 9 to 11. FIG. 9 shows the side handle 110 partially in section. FIG. 10 is a sectional view taken along line D-D in FIG. 9, and FIG. 11 is a sectional view taken along line E-E in FIG. 9. This embodiment is a modification to the construction of the grip side and the vibration reducing structure of the side handle 110, and in the other points, it has the same construction as the above-described first embodiment. Components or elements in the fifth embodiment which are substantially identical to those in the first embodiment are given like numerals as in the first embodiment and will not be described or will be only briefly described.

In this embodiment, as shown in FIG. 9, a stay 161 is provided which extends parallel to the grip 121 and connects the ends of the upper and lower arms 123 extending transversely to the longitudinal direction of the grip 121 from the ends of the grip 121 in its longitudinal direction. The stay 161 is a feature that corresponds to the "transverse part" according to this invention. In this embodiment, the grip of the side handle 110 is configured as a closed loop of an integral frame structure having the grip 121, the upper and lower arms 123 and the stay 161. With this construction, the rigidity of the grip 121 can be increased and the durability can be enhanced.

Further, in this embodiment, upper and lower horizontal projections 163 are formed on the upper and lower portions of the stay 161. Upper and lower rubber receiving members 165 are each arranged to individually surround the associated projections 163. Further, an elastic rubber 167 is disposed between the rubber receiving member 165 and the projection 163. The bases 115 of the ring components 113 of the mounting ring 111 are arranged between the upper and lower rubber receiving members 165. The rubber receiving members 165 and the bases 115 which are vertically aligned are clamped by the through bolt 131 and the clamping knob 135 with the nut 133.

As shown, each of the rubber receiving members 165 has a box-like shape which surrounds or covers the projection 163 substantially in its entirety, or specifically, all the sides of the projection 163 except its region of connection with the stay 161. Further, the rubber receiving member 165 has a through hole through which the through bolt 131 extends, and a cam face is provided on the side of the rubber receiving member 165 which faces the associated base 115 and engages with a cam face formed on the base 115. Therefore, when the through bolt 131 and the clamping knob 135 with the nut 133 are tightened, the rubber receiving member 165 is connected to the base 115 of the mounting ring 111 such that it cannot rotate with respect to the base 115.

Further, a predetermined clearance is provided between the inner surface of the rubber receiving member 165 and the outer surface of the projection 163 so as to allow the rubber receiving member 165 and the projection 163 to move with respect to each other even when the through bolt 131 and the clamping knob 135 with the nut 133 are tightened. The elastic rubber 167 is disposed on all the sides, or specifically, in all of the longitudinal, vertical and lateral directions, between the inner surface of the rubber receiving member 165 and the outer surface of the projection 163. As shown in FIGS. 10 and 11, the elastic rubber 167 is supported by an engagement recess 163*a* formed in the front and rear surfaces of the projection 163 and held in contact with the inner surface of the rubber receiving member 165.

Therefore, according to this embodiment, the effect of reducing vibration of the grip 121 by elastic deformation of the elastic rubber 167 can be obtained in each of the longitudinal, vertical and lateral directions.

Sixth Embodiment of the Invention

Figure 12:
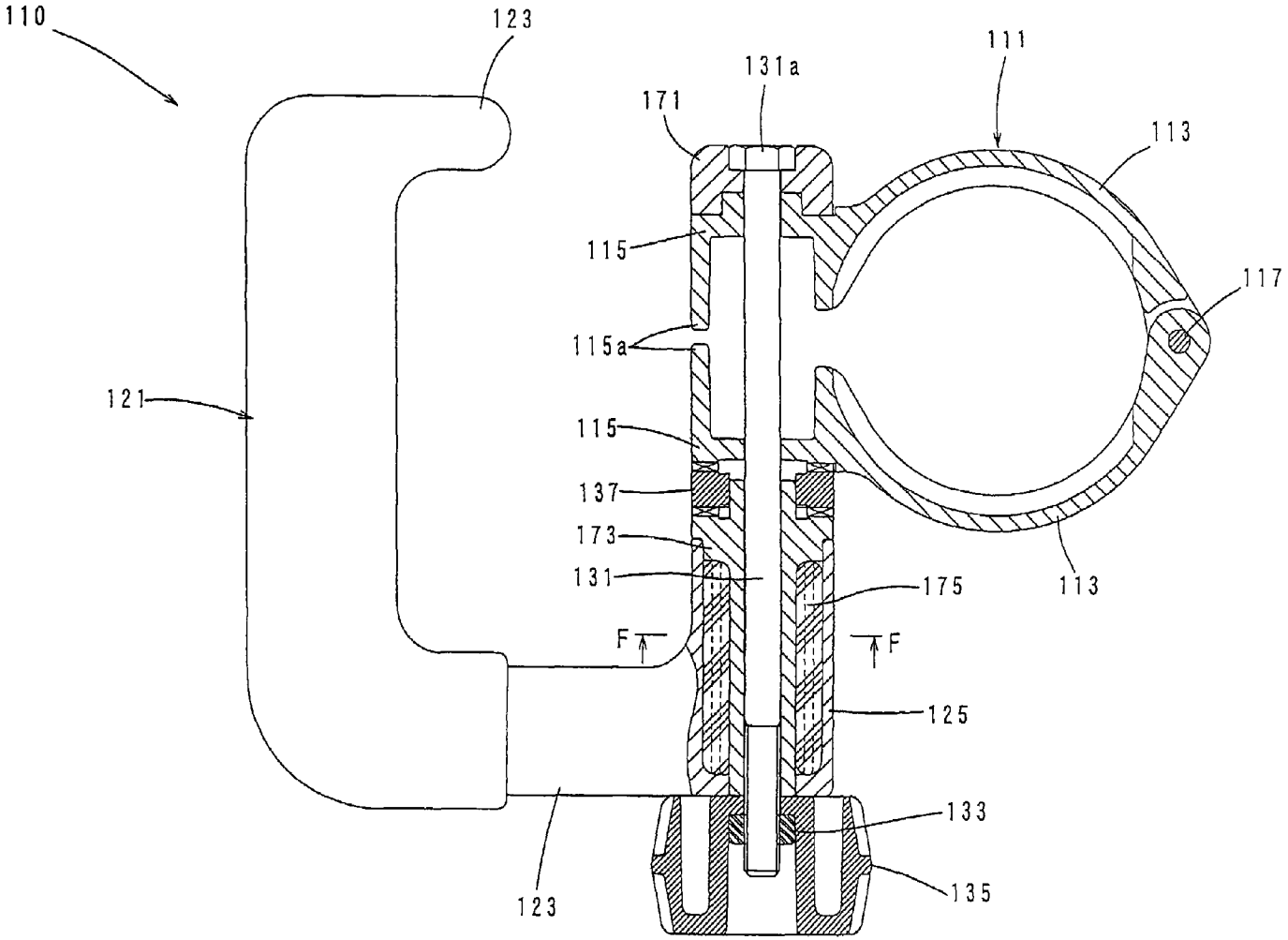
FIG. 12 is a partially sectional view showing the construction of the side handle according to a sixth embodiment of the invention.
Figure 13:
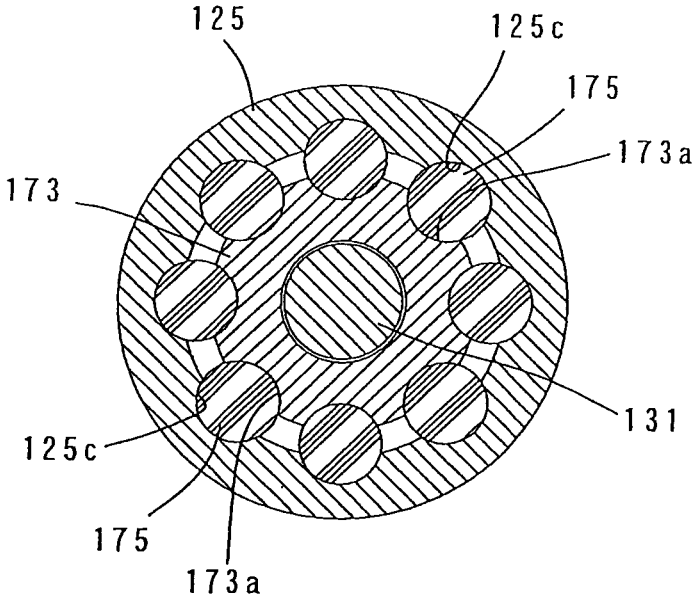
FIG. 13 is a sectional view taken along line F-F in FIG. 12.

A sixth embodiment of the present invention is now described with reference to FIGS. 12 and 13. FIG. 12 shows the side handle 110 partially in section, and FIG. 13 is a sectional view taken along line F-F in FIG. 12. This embodiment is a modification to the construction of the grip side and the vibration reducing structure of the side handle 110, and in the other points, it has the same construction as the above-described first embodiment. Components or elements in the sixth embodiment which are substantially identical to those in the first embodiment are given like numerals as in the first embodiment and will not be described or will be only briefly described.

In this embodiment, one (lower arm) of the upper and lower arms 123 which extend from the both longitudinal ends of the grip 121 in a direction transverse to the longitudinal direction of the grip 121 is connected to the mounting ring 111, while the other arm (upper arm) 123 is designed as a non-connected structure. Specifically, in this embodiment, the grip 121 is generally L-shaped having the arms 123, so that the upper arm 123 can be utilized, for example, as a wall-mounting hook for storing the side handle 110. Thus, the convenience in storing the side handle 110 is enhanced.

Further, in this embodiment, the bases 115 of the upper and lower ring components 113 of the mounting ring 111 are disposed between a bolt receiver 171 on the upper side and a cylindrical rubber receiving member 173 via the cam 137 on the lower side, and these members are clamped by the through bolt 131 extending through these members, and the clamping knob 135 with the nut 133.

As shown in FIG. 13, the extending end portion 125 of the lower arm 123 is cylindrical and loosely fitted over the rubber receiving member 173 from below in such a manner as to be allowed to move with respect to the rubber receiving member 173. Further, a plurality of columnar (pin-like) elastic rubbers 175 are disposed between the mating faces of the rubber receiving member 173 and the extending end portion 125 and arranged at predetermined intervals in the circumferential direction. A plurality of engagement recesses 173*a* having a semicircular section are formed in the outer circumferential surface of the rubber receiving member 173 and extend in the longitudinal direction (the vertical direction). Correspondingly, a plurality of engagement recesses 125*c* having a semicircular section are formed in the inner circumferential surface of the extending end portion 125. The columnar elastic rubbers 175 are held between the opposed engagement recesses 173*a* and 125*c*. In other words, the elastic rubbers 175 are supported by the same structure as in FIG. 8 as described above. Further, one (upper) end of each of the elastic rubbers 175 in the longitudinal direction is held in contact with an end surface of the associated engagement recess 173*a* of the rubber receiving member 173, and the other (lower) end of the elastic rubber 175 in the longitudinal direction is held in contact with an end surface of the engagement recess 125*c* of the extending end portion 125.

Therefore, according to this embodiment, like in the above-described fifth embodiment, the effect of reducing vibration of the grip 121 by elastic deformation of the elastic rubbers 175 can be obtained in each of the longitudinal, vertical and lateral directions. At the same time, like in the fourth embodiment, vibration of the grip 121 can be reduced in the longitudinal and lateral directions by utilizing deformation mainly comprising shear deformation.

Seventh Embodiment of the Invention

Figure 14:
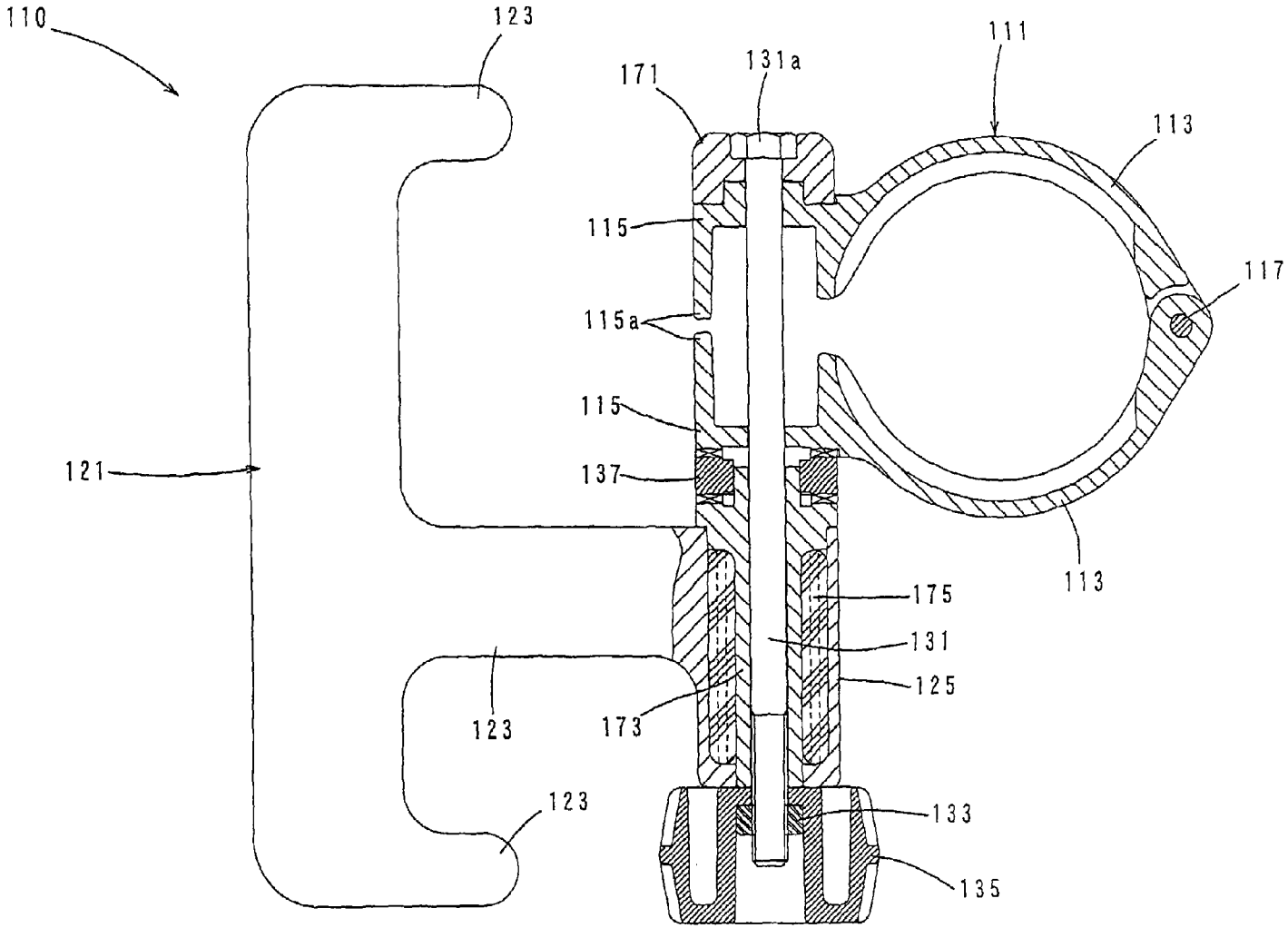
FIG. 14 is a partially sectional view showing the construction of the side handle according to a seventh embodiment of the invention.

A seventh embodiment of the present invention is now described with reference to FIG. 14. FIG. 14 shows the side handle 110 partially in section. This embodiment is a modification to the sixth embodiment. As shown, the grip 121 has three arms 123 which extend from the both longitudinal (vertical) ends of the grip 121 and from a midpoint between the ends of the grip 121, respectively, in a direction transverse to the longitudinal direction of the grip 121. Only the middle one of the three arms 123 is connected to the mounting ring 111, while the upper and lower arms 123 are designed as a non-connected structure. In the other points, it has the same construction as the above-described sixth embodiment. Components or elements in the seventh embodiment which are substantially identical to those in the sixth embodiment are given like numerals as in the sixth embodiment and will not be described.

As described above, in this embodiment, the grip 121 is generally T-shaped having the arms 123, so that the upper and lower arms 123 can be each utilized, for example, as a wall-mounting hook for storing the side handle 110. Therefore, according to this embodiment, almost the same effect as the sixth embodiment can be obtained.

Eighth Embodiment of the Invention

Figure 15:
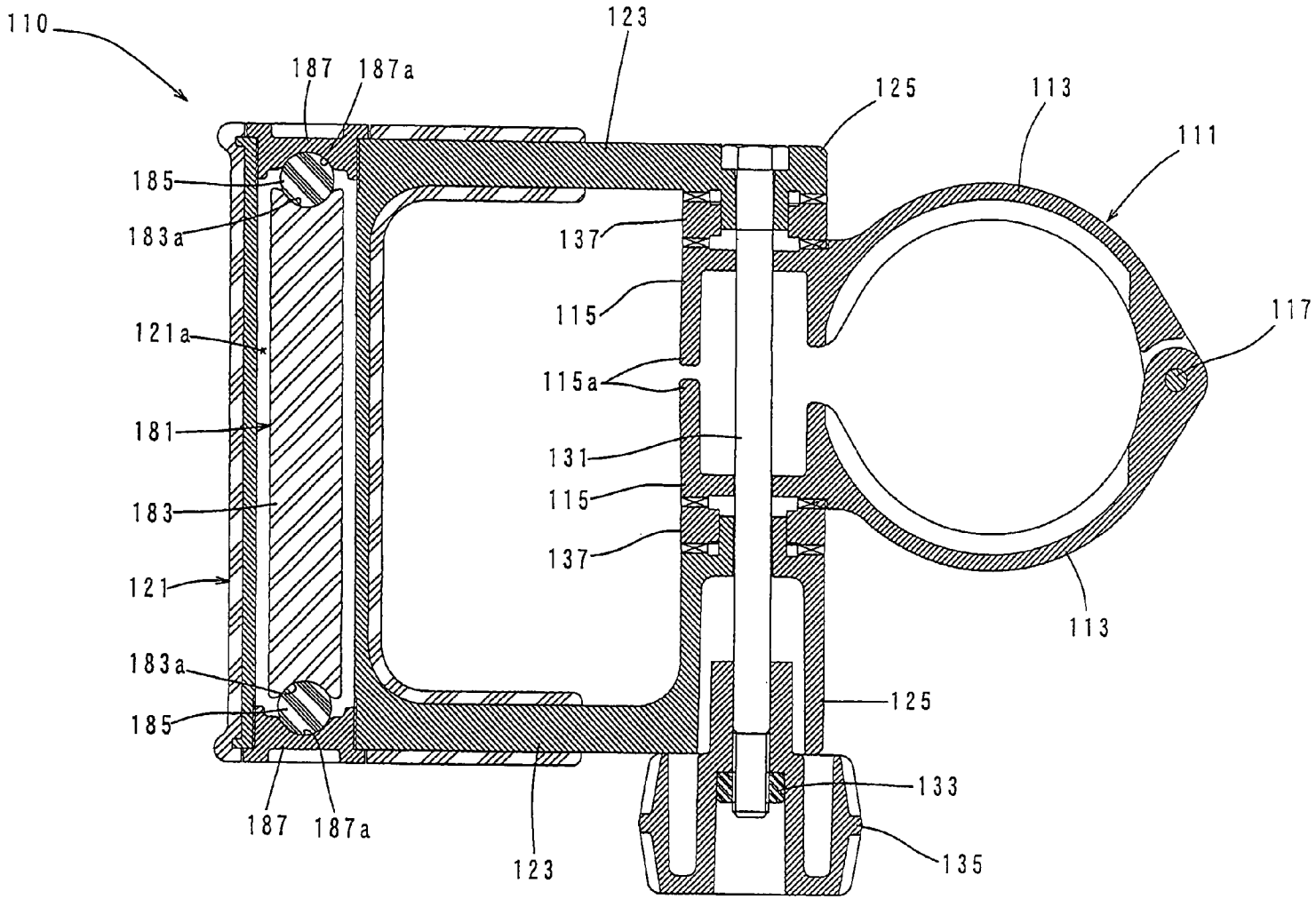
FIG. 15 is a sectional view showing the construction of the side handle according to an eighth embodiment of the invention.

An eighth embodiment of the present invention is now described with reference to FIG. 15. FIG. 15 shows the side handle 110 in section. In this embodiment, a dynamic vibration reducer 181 is installed in the side handle 110 in order to reduce vibration of the side handle 110 (the grip 121). Specifically, the grip 121 is hollow and the dynamic vibration reducer 181 is disposed in the internal space of the grip 121 in the form of a hollow portion 121*a*. The dynamic vibration reducer 181 includes a weight 183 in the form of a rod-like or columnar element disposed in the hollow portion 121*a* and extending in the longitudinal (vertical) direction of the grip 121, and an elastic element in the form of a spherical rubber 183 which supports the weight 183 in such a manner as to allow movement of the weight 183. The spherical rubber 183 is held between a spherical recess 183*a* formed in each of the longitudinal ends of the weight 183 and a spherical recess 187*a* formed in each of plugs 187 which are provided to close the both open ends of the hollow portion 121*a* of the grip 121.

According to this embodiment having the above-described construction, during operation using the hammer drill 101, the dynamic vibration reducer 181 installed in the side handle 110 passively reduces vibration of the side handle 110 by cooperation of the weight 183 and the spherical rubber 185 which comprise vibration reducing elements in the dynamic vibration reducer 181. As a result, vibration caused in the side handle 110 can be reduced. In this embodiment, the weight 183 has a columnar shape and is supported at the longitudinal ends by the spherical rubbers 185. Therefore, the grip 121 can be designed to have an easy-to-grip outside diameter, and the weight 183 can be elastically supported in a rational manner. Further, in addition to the support of the weight 183 at the both ends by the spherical rubbers 185, each of the spherical rubbers 185 is held between the spherical recess 183*a* on the weight 183 side and the spherical recess 187*a* on the grip 121 side. Therefore, the vibration reducing effect can be obtained in each of the longitudinal, vertical and lateral directions of the tool bit.

In the structure shown in FIG. 15, an elastic rubber for reducing transmission of vibration as described in the first to seventh embodiments is not provided in a region between the mounting ring 111 and the grip 121, but this embodiment can be used in combination with any one of the vibration transmission reducing structures described in the first to seventh embodiments. In this case, vibration which is transmitted to the grip 121 without being completely reduced by the elastic rubber can be further reduced by the dynamic vibration reducer 181, so that the effect of reducing vibration of the grip 121 can be further enhanced.

Further, although the first to eighth embodiments are described as to the side handle 110 applied to the hammer drill 101, its applicability is not limited to the hammer drill 101, but it can also be widely applied to an impact tool such as a hammer, a cutting power tool, such as a reciprocating saw and a jig saw, which performs a cutting operation on a workpiece by reciprocating movement of a blade, and other hand-held power tools.

Further, the structures of reducing transmission of vibration of the grip 121 by using the elastic rubber in the fifth to seventh embodiments can be appropriately replaced with any one of those in the first to fourth embodiments.

Having regard to the invention, following technical concept can further be provided:

"An auxiliary handle, including:

a ring-like mounting part which is capable of holding a power tool body of a hand-held power tool from outside, a pair of bases formed on a free end of the mounting part, and a rod-like grip to be held by a user, the grip having one or more arms extending in a direction transverse to a longitudinal direction of the grip, wherein the bases of the mounting part and extending end portions of the arms are arranged parallel to the longitudinal direction of the grip, and the bases of the mounting part and the extending end portions of the arms are clamped by a bolt extending therethrough in the longitudinal direction of the grip and a nut, so that the mounting part holds the power tool body, characterized in that:

a dynamic vibration reducer is installed in the grip and has a different elastic element from the elastic region and a weight which moves with respect to the grip via the elastic element."

With this construction, during operation using the hand-held power tool, the dynamic vibration reducer passively reduces vibration of the auxiliary handle by cooperation of the weight and the elastic element which comprise vibration reducing elements in the dynamic vibration reducer. As a result, vibration caused in the auxiliary handle can be reduced.

"The auxiliary handle, wherein the grip has an internal space and the dynamic vibration reducer is disposed in the internal space."

With this construction, in which the dynamic vibration reducer is disposed in the internal space of the grip, effective use can be made of the space. Further, no adverse effect is produced on the appearance and the ease-to-grip property of the grip.

DESCRIPTION OF NUMERALS

101 hammer drill (hand-held power tool)
103 body
105 housing
107 barrel
109 main handle
110 side handle (auxiliary handle)
111 mounting ring (mounting part)
113 ring component
113*a* projections and depressions
113*b* cylindrical portion
113*c* rib
115 base
115*a* stopper
115*b* rib
115*c* engagement recess
117 shaft
119 hammer bit
121 grip
121*a* hollow portion
123 arm
125 extending end portion
125*a* circular recess (recess)
125*b* engagement recess
125*c* engagement recess
131 through bolt
131*a* head
133 nut
135 clamping knob
137 cam
141 elastic rubber (elastic region)
143 elastic rubber (elastic region)
145 rubber receiving member (surrounding member)
147 elastic rubber (elastic region)
149 washer
151 rubber receiving member (intermediate member)
151*a* flange
151*b* outer cylindrical portion (projection)
151*c* engagement recess
153 elastic rubber (elastic region)

155 washer
161 stay (transverse part)
163 projection
163*a* engagement recess
165 rubber receiving member
167 elastic rubber (elastic region)
171 bolt receiver
173 rubber receiving member
173*a* engagement recess
175 elastic rubber (elastic region)
181 dynamic vibration reducer
183 weight
185 spherical rubber (elastic element)
187 plug
183*a* spherical recess
187*a* spherical recess

What we claim is:

1. An auxiliary handle comprising:

a plurality of ring-like mounting components having projections and depressions formed discontinuously in the circumferential direction in an inner circular arc surface of each of the plurality of ring-like mounting components, the plurality of ring-like mounting components being capable of holding a power tool body of a hand-held power tool from outside, a pair of bases formed on a free end of the plurality of mounting components, a rod-like grip to be held by a user, one or more arms provided with the grip, the arms extending in a direction transverse to a longitudinal direction of the grip, wherein the bases of the plurality of mounting components and extending end portions of the arms are arranged parallel to the longitudinal direction of the grip, and wherein the bases of the plurality of mounting components and the extending end portions of the arms are clamped by a bolt and a nut such that the plurality of mounting components hold the power tool body, and a plurality of elastic regions having projections and depressions formed discontinuously in a circumferential direction of the plurality of ring-like mounting components to reduce vibration, the plurality of elastic regions being provided in at least one of the plurality of mounting components, the bases and the extending end portions of the arms, wherein the plurality of elastic regions are provided on the inner circular arc surfaces of the plurality of mounting components which hold the power tool body, and the projections of the plurality of ring-like mounting components are inserted within corresponding depressions of the plurality of elastic regions, and the projections of the plurality of elastic regions are inserted within corresponding depressions of the plurality of ring-like mounting components, thereby increasing a joint area and a joint strength between respective ring-like mounting components and elastic regions.

* * * * *